United States Patent [19]

Ebeling et al.

[11] Patent Number: 4,683,685

[45] Date of Patent: Aug. 4, 1987

[54] DRAINING ARRANGEMENT FOR ROOF

[75] Inventors: Olavi Ebeling; Risto Lunden, both of Helsinki, Finland

[73] Assignee: Oy Kontekla, Helsinki, Finland

[21] Appl. No.: 877,713

[22] PCT Filed: Mar. 7, 1983

[86] PCT No.: PCT/FI83/00021

§ 371 Date: Nov. 3, 1983

§ 102(e) Date: Nov. 3, 1983

[87] PCT Pub. No.: WO83/03114

PCT Pub. Date: Sep. 15, 1983

Related U.S. Application Data

[63] Continuation of Ser. No. 552,031, Nov. 3, 1983, abandoned.

[30] Foreign Application Priority Data

| | | | |
|---|---|---|---|
| Mar. 9, 1982 | [FI] | Finland | 820807 |
| Mar. 11, 1982 | [FI] | Finland | 820846 |
| Jan. 24, 1983 | [FI] | Finland | 830227 |

[51] Int. Cl.[4] ..... E04D 13/00; E02B 5/08

[52] U.S. Cl. ..... 52/12; 52/11; 405/119; 210/163

[58] Field of Search ..... 405/36, 118–121; 52/11, 12, 16, 15; 210/163–166

[56] References Cited

U.S. PATENT DOCUMENTS

| | | | |
|---|---|---|---|
| 803,316 | 10/1905 | Vogel | 52/16 X |
| 1,999,277 | 4/1935 | Boosey | 210/163 |
| 3,355,895 | 12/1967 | Bayes et al. | 405/120 |
| 4,107,929 | 8/1978 | Ebeling et al. | 405/119 |
| 4,112,691 | 9/1978 | Ebeling et al. | 405/119 |
| 4,385,010 | 5/1983 | Bosne | 405/119 X |

FOREIGN PATENT DOCUMENTS

| | | | |
|---|---|---|---|
| 419464 | 8/1981 | Sweden . | |
| 539756 | 9/1973 | Switzerland . | |
| 1216292 | 12/1970 | United Kingdom | 52/12 |

*Primary Examiner*—Cornelius J. Husar
*Assistant Examiner*—Nancy J. Stodola
*Attorney, Agent, or Firm*—Cushman, Darby & Cushman

[57] ABSTRACT

A draining arrangement for removing water from roofs or equivalent areas wherein the aim of the arrangement is to improve the draining effect making it possible to use smaller draining pipes, and further to avoid disturbing noise in the pipes. The arrangement is mainly characterized in that the opening (4) of the vertical water pipe (3) is situated directly at the surface (1) of the roof and is covered by a lid element (5). This lid is situated at a height ($h_c$) over the roof that a certain predefined amount of water can flow under the lid where the water stream while on its way to the opening of the vertical draining pipe and without changing its direction, continuously changes to closed flow simultaneously as the air entrance becomes closed.

9 Claims, 6 Drawing Figures

DRAINING ARRANGEMENT FOR ROOF

This is a continuation of application Ser. No. 552,031, filed Nov. 3, 1983, which was abandoned upon the filing hereof.

BACKGROUND OF THE INVENTION

1. Field of the Invention

The present invention is concerned with an apparatus for the draining of rain water from roofs or the equivalent. The apparatus is based on the principle of providing closed flow in the vertical draining pipe at the dimensioned water quantity, so that the draining is intensified and smaller and less expensive conduits can be used as compared with pipe systems requiring mixed flow, in which, thus, both air and water flow.

2. Description of the Related Art

In the dimensioning of rain water pipes, different modes are in use in different countries, and for the dimensioning of the conduits, so-called dimensioning rainwater quantities have also been defined, the maximum intensity being, e.g., in Finland 150 l/s/ha (liters per second per hectare), in Sweden 130 l/s/ha, in Germany in certain places 400 l/s/ha.

It is known in the prior art to provide a closed flow, e.g., by fitting a so-called roof well inti the roof, into which the water flowing from the roof is collected and in whose bottom portion there is an opening for connecting the vertical draining pipe. The opening is covered by a solid cover, whose perforated edges have been bent downwards so as to form a water lock when the roof well is full of water. The objective is to prevent the access of air and the formation of a water vortex in the opening of the draining pipe (FI Pat. No. 41,451).

According to another suggested construction in the prior art, attempts are made to prevent access of air into the vertical draining pipe by placing a plug-like conical cover member in the mouth opening of the pipe whose shape corresponds to the air vortex of water when water rushes into an opening freely (FI Pat. No. 58,193).

Primary drawbacks of the prior art solutions are the high costs of roof wells, reduction in the thickness of the insulation, and, moreover, that the water is not drained uniformly. The water flows into the roof well rather uniformly, but is emptied from it unevenly. So-called swinging is produced when the water level in the roof well is alternatingly going up and down. The efficient draining caused by closed flow empties the roof well rapidly. Thereupon air is mixed with the water for some time, whereat the flow rate is reduced until the well is again filled, whereat access of air is prevented and closed flow starts again. The phenomenon is noticed as a disturbing water shock and as noise.

SUMMARY OF THE INVENTION

The present invention eliminates the drawbacks in the prior art. No roof well, i.e. recess, is needed at all, but the rain water is passed straight into the discharge opening placed in the roof surface.

It is characteristic of the principle of the apparatus in accordance with the invention that on the roof the water, flowing as open flow from the starting point towards the discharge point, is passed, without changing its flow direction and substantially at the speed of the open flow, into a space in which the open flow, when the intensity of rain increases, is continuously converted to closed flow so that, when the space is filled with water, air is excluded. The water is passed into an opening placed in the space and fitted to the roof portion, through which opening the water is discharged through the pipe system into the ultimate discharge point. Under these circumstances, the level of the water on the roof exclusively complies with the rules of open flow. In the closed flow obtained in this way, the static pressure of the water column flowing in the discharge pipe is utilized for the flow resistances, and normal formulae of calculation of closed flow can be applied to the dimensioning of the rain water pipe systems. Under these circumstances, the loss of pressure in the pipe system is equal to the difference in height from the roof to the point at which the water is ultimately removed from the area. This point is usually, e.g., within an area with city plan, the municipal storm sewer.

In the apparatus in accordance with the invention, a cover plate of specified dimensions is fitted above the discharge opening in the roof and at such a height that a predetermined quantity of water has space enough to pass within a unit of time underneath the cover towards the discharge opening. As the layer of water on the roof is approaching the permitted maximum height, the access of air to the space underneath the cover is restricted. Thus, the content of air in the water underneath the cover is reduced as the intensity of rain increases, until the air content is zero and closed flow of water has been achieved. The removal of water is intensified and the level of water on the roof can be kept under control. It cannot rise to a level risking the load capacity of the roof or of the trough.

In view of the accomplishment of the above occurrence, the apparatus in accordance with the invention is placed in an opening in the surface of the roof and is characterized in a disc member fitted above the opening. The magnitude of the disc, its height above the roof surface, as well as the diameter of the water discharge pipe and of the discharge opening are precisely dimensioned in accordance with the quantity of water to be drained.

The water collecting zones on the roof must, of course, be divided into zones of such a size that the level of the water on the roof does not exceed the permitted limits at the initial end of the flow, owing to the rules of open flow prevailing there. This height is commonly 50 mm.

In order that the water could be drained from the roof in compliance with the rules of open flow, the discharge opening must be large enough so that the overflow or over-rushing can take place undisturbed. The overflow height or over-rush height of the water into such an opening follows the equation $$u_c=\sqrt{g\cdot h_c},$$

wherein $u_c$=speed at the beginning of overflow $h_c$=overflow height (see FIG. 1)

In the case of very wide troughs, the water height at the initial end of the flow is about $3/2\cdot h_c$.

In a circular opening whose diameter is d, the cross-sectional flow area F and, correspondingly, the quantity of water flow Q at the overflow point are obtained as follows:

$$F=h_c\cdot\pi\cdot d$$

$$Q = u_c \cdot h_c \cdot \pi \cdot d$$

By in the above equation placing the equation of $u_c$, the interdependence of Q, $h_c$ and d is obtained as follows:

$$Q = \pi \cdot d \cdot \sqrt{g \cdot h_c^3} \text{ or}$$

$$d = \frac{Q}{\pi \cdot \sqrt{g \cdot h_c^3}}$$

In order to illustrate the invention and the construction in accordance with same, the following practical example is given. The area of the roof zone to be drained is assumed to be 500 $m^2$, the maximum rain intensity 150 l/s/ha, whereat the quantity of water to be drained is 7.5 l/s. Thereat, according to experience, the diameter of the inlet of the appropriate discharge pipe is about 50 mm. When the water height at the initial end of the flow is 50 mm, $h_c$ at free discharge is 33.3 mm. From these values, by means of the above formulae, the diameter of the circular disc of at least 125.5 mm is obtained, and the length of the circumference, correspondingly, is at least 394 mm. The speed of open flow at the edge of the disc is 0.57 m/s, and also equal to the quantity of water divided by the area of free opening. The speed of the water flow underneath the disc is accelerated as closed flow is produced, so that the speed of the water in the discharge pipe will be about 3.8 m/s. The flow rate is also affected by the pressure of the water column in the discharge pipe. By means of the suggested solution, it is possible to increase the speed of the water, as is indicated by experiments, without raising the water level on the roof, without a vortex phenomenon and without suction of air induced by that phenomenon.

After the maximum quantity of water to be drained from the roof zone concerned has been determined and after the maximum permitted height of water at the initial end of the flow has been decided—thus, usually 50 mm—above the roof surface and on top of the discharge pipe, a disc is fitted which is above the roof surface at the maximum height h. The length of the edge at which the disc is fitted is at least equal to the length of the circular edge obtained from the formula. A disc dimensioned and fitted in this way, together with a discharge pipe system dimensioned in accordance with the closed-flow principle, is, with an increase in the intensity of rain, capable of converting the open flow taking place on the roof, continuously, without changing the direction of flow on the roof, to closed flow when the water rises, in accordance with the rules of open flow, to the level of the disc height, and by means of the apparatus it is possible to drain the rain water from the roof by pipes of a diameter considerably smaller than in prior art solutions.

The disc may be, but does not have to be, solid, because, when the height of water is slightly lower than the overflow height, the little layer of water formed on the disc will seal the disc adequately to prevent the drawbacks of air sucked in, and to form a continuous column of water with the dimensioned quantity of water.

BRIEF DESCRIPTION OF THE DRAWINGS

The attached drawing illustrates, in FIG. 1, the flow of water into the pipe or opening and, in FIGS. 2 to 5, different construction examples of the apparatus in accordance with the invention.

The disc 5 may, of course, be of any arbitrary shape whatsoever, whereat the minimum length of its edge determines the maximum height position of the disc 5 from the roof plane 1 in accordance with the principle described above.

Figure 1:
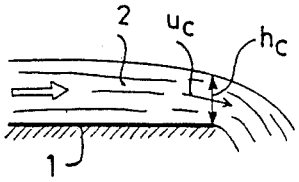
In FIG. 1, the speed of the water flow 2 on the roof plane 1 is at the beginning of overflow $u_c$, and the overflow height is $h_c$.
Figure 2:
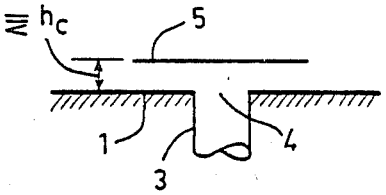
In FIG. 2, the rainwater pipe 3 in the roof plane 1 has an opening 4, and the disc 5 is fitted above the opening. The distance of the disc 5 from the roof plane 1 is at the maximum $h_c$.

When the water flows between the roof plane 1 and the disc 5, the speed of the water increases towards the opening 4 of the pipe 3 if the faces are parallel, whereat the flow resistance also increases towards the starting point, as shown in FIG. 2.

Figure 4:
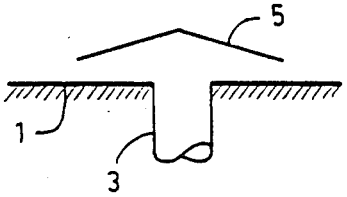
FIGS. 4 and 5 show two other embodiments of the apparatus. In one of them, the plane of the disc 5 is bent, in the other one the screen element 6 extends, resembling a conical mantle face, from the edges of the disc 5 down to the roof plane 1.
Figure 5:
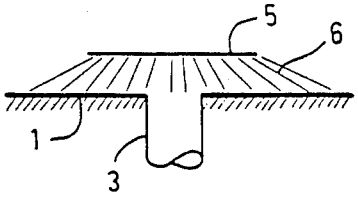
Figure 6:
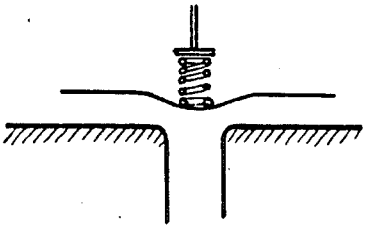
FIG. 6 shows an embodiment in which the disc 5 is elastic and its shape is determined by the compression of a spring placed on top of the disc 5.

In order to prevent this occurrence and, consequently, to reduce the flow resistance, the disc 5 or the portion of the roof plane 1 placed underneath the disc 5, or both of them simultaneously, may be shaped so that the flow resistance towards the starting point is not increased as in, FIG. 4.

Figure 3:
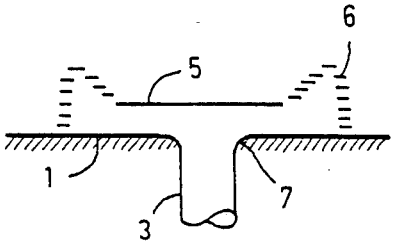
FIG. 3 shows such a modification in which a screen element 6 has been attached to the edges of the disc 5.

Moreover, the form resistance caused by the transition to the starting point, into the opening 4 of the pipe 3, may be reduced by rounding the joint 7 between the roof plane 1 and the pipe 3, as shown in FIG. 3.

The disc 5 or the portion underneath the disc 5, or both may also be shaped so that the portions are provided with radial reinforcement ribs or grooves, which, at the same time, act as retarders of the tendency of whirling around of the water, by increasing the friction of the whirl flow of water. All of the above solutions may occur with or without a screen 6. Further, the disc 5 may also be elastic, e.g., by a spring device, and may be designed to be adjustable in accordance with various desires.

As one modification of the apparatus, the disc 5 is fitted substantially in the the roof plane 1, whereat the flow-in opening for the water is substantially annular between the edge of the disc 5 and the roof plane 1. In such a case, the length of the edge of the disc 5 and the width of the opening 4 follow the rules described above.

We claim:

1. Apparatus for the draining of water from a roof having an overall flat upper surface lying in a roof plane comprising:

a water discharge opening having a periphery, the periphery lying in said roof plane;

a generally vertical drain conduit extending downwardly from said discharge opening, said drain conduit having a cross section corresponding to the cross section of said discharge opening and being capable of carrying rain water at a prdetermined flow rate; and a flow control disc having a peripheral edge, said disc being positioned directly above said discharge opening, said disc being spaced above the roof plane approximately $\frac{2}{3}$ of a height corresponding to said predetermined flow rate and being larger than said discharge opening, the height of said disc and its horizontal dimensions being such that the length of the edge of the disc and the height of the disc spaced above the roof plane correspond to the quantity of water that flows at said predetermined flow rate at the discharge opening;

whereby in the space underneath the disc the water flow is converted to closed flow continuously.

2. Apparatus as in claim 1 including a screen element connected to the peripheral edge of the disc and extending downwardly to the upper surface of the roof.

3. Apparatus as in claim 1 wherein the distance between the disc and the roof plane changes from the edge of the disc toward the center of the disc.

4. Apparatus as in claim 1 wherein the peripheral edge of the discharge opening is a rounded joint means for reducing resistance to water flow.

5. Apparatus as in claim 1 wherein the disc or the roof portion below the disc, or both, are provided with surface contours, e.g. ribs or grooves, which increase the friction of a swirling flow movement.

6. Apparatus as in claim 1 wherein the disc is solid.

7. A rain water outlet for a roof having an overall flat upper surface lying in a roof plane comprising:

a water discharge opening in the roof at the roof plane;

a downwardly extending vertical outlet pipe of the same horizontal dimensions as the discharge opening; and a disc element positioned above the discharge opening, the disc element having a diameter greater than the discharge opening and spaced thereabove;

said water outlet pipe being capable of carrying away rain water at a predetermined flow rate, said disc element being spaced above the discharge opening in the roof plane at a height corresponding to approximately $\frac{2}{3}$ of said predetermined flow rate;

whereby an air whirl is prevented from being formed in the outlet pipe so that the water flow is converted to closed flow continuously.

8. A rain water outlet arrangement for a roof having an overall flat upper surface lying in a roof plane comprising:

a water discharge opening in the roof at the roof plane;

a downwardly extending vertical outlet pipe of the same horizontal dimensions as the discharge opening; and a disc element positioned above the discharge opening and having a diameter greater than the discharge opening, the roof being capable of carrying rain water at a predetermined depth, said disc element being spaced above the discharge opening in the roof plane approximately $\frac{2}{3}$ of said predetermined depth;

whereby the outlet pipe is capable of carrying away a volume of rain water corresponding to the predetermined height of rain water on the roof without an air whirl being formed in said outlet pipe.

9. A method for removing rain water from a roof having an overall flat upper surface lying in a roof plane by an arrangement comprising a water discharge opening in the roof at the roof plane, a downwardly extending vertical outlet pipe of the same horizontal dimensions as the discharge opening, a disc having a diameter greater than the discharge opening and being positioned above said discharge opening in the roof plane, the method comprising the steps of:

determining the height of rain water on the roof at a maximum rate of rainfall; and spacing the disc approximately $\frac{2}{3}$ of said height above the discharge opening in the roof plane.

* * * * *